US006892967B2

(12) United States Patent
Tappolet et al.

(10) Patent No.: US 6,892,967 B2
(45) Date of Patent: May 17, 2005

(54) FUEL-INJECTION VALVE FOR INTERNAL COMBUSTION ENGINE

(75) Inventors: Markus Tappolet, Schaffhausen (CH); Andreas Carelli, Zurich (CH); Marco Ganser, Oberageri (CH); Severin Kern, Winterthur (CH); Roland Kolb, Regensdorf (CH)

(73) Assignee: CRT Common Rail Technologies AG, Neuhausen am Rheinfall (CH)

( * ) Notice: Subject to any disclaimer, the term of this patent is extended or adjusted under 35 U.S.C. 154(b) by 185 days.

(21) Appl. No.: 10/187,014

(22) Filed: Jul. 2, 2002

(65) Prior Publication Data

US 2003/0052198 A1 Mar. 20, 2003

(30) Foreign Application Priority Data

Jul. 3, 2001 (CH) ..... 1217/01

(51) Int. Cl.[7] ..... F02M 59/00; F02M 39/00; F02M 47/02; B05B 1/30

(52) U.S. Cl. ..... 239/533.2; 239/533.3; 239/533.7; 239/533.8; 239/533.9; 239/88; 239/585.1; 239/585.5

(58) Field of Search ..... 239/533.2, 533.3, 239/533.7, 533.8, 533.9, 88–93, 585.1–585.5; 251/129.15, 129.21, 127

(56) References Cited

U.S. PATENT DOCUMENTS

| | | | | |
|---|---|---|---|---|
| 4,566,634 A | * | 1/1986 | Wiegand | 239/410 |
| 4,946,103 A | | 8/1990 | Ganser | |
| 5,397,055 A | * | 3/1995 | Paul et al. | 239/124 |
| 5,636,615 A | * | 6/1997 | Shorey et al. | 123/506 |
| 5,655,716 A | | 8/1997 | Mathis | |
| 6,257,496 B1 | * | 7/2001 | Wyant | 239/5 |

FOREIGN PATENT DOCUMENTS

| | | |
|---|---|---|
| DE | 195 29 826 | 12/1996 |
| EP | 0 228 578 | 7/1987 |
| EP | 0 426 205 | 5/1991 |
| EP | 0 571 003 | 11/1993 |
| EP | 0 909 892 | 4/1999 |

* cited by examiner

*Primary Examiner*—Davis Hwu
(74) *Attorney, Agent, or Firm*—Oblon, Spivak, McClelland, Maier & Neustadt, P.C.

(57) ABSTRACT

The control space of the fuel injection valve is delimited, on the one hand, by the piston of the injection-valve member, on the other hand by the slide-valve body and circumferentially by the sleeve. Both the double-acting piston and the slide-valve body are guided in a narrow sliding fit on the sleeve. The throttle passage runs through the slide-valve body and is flow-connected permanently to the control passage in the control body. The throttle inlet leads from the high-pressure space into the control passage. The latter, on the side facing away from the slide-valve body, can, via a pilot valve, be connected to a low-pressure space and be separated again from the latter. The connection of the control passage to the low-pressure space leads to a pressure drop in the control space, with the result being that the injection-valve member moves in the direction of the slide-valve body and releases the injection nozzles. After the control passage has been separated from the low-pressure space, as a result of the pressure difference in the control space and on that side of the slide-valve body which faces away from the latter, the slide-valve body, together with the injection valve, is moved in a direction away from the control body, thus leading to a rapid closing of the injection nozzles. Under the force of the spring element, the slide valve body then again sealingly engages the control body.

22 Claims, 9 Drawing Sheets

FUEL-INJECTION VALVE FOR INTERNAL COMBUSTION ENGINE

BACKGROUND OF THE INVENTION

1. Field of the Invention

The present invention relates to a fuel injection valve for intermittent fuel injection into the combustion space of an internal combustion engine.

2. Discussion of the Background

A fuel injection valve is disclosed in EP-A-0 675 281 and U.S. Pat. No. 5,655,716. A control piston of a nozzle needle projects at the upper end into a control chamber. Above this control piston is arranged a valve, of which the valve body running coaxially to the control piston is guided laterally sealingly in the valve housing. The valve body projects with one end face facing the control piston into the control chamber and with the other end face into an additional chamber which communicates with an outflow line via a control valve and which is connected to the control chamber via a throttle bore leading through the valve body. This throttle bore and therefore the control chamber are permanently connected to the high-pressure part of the fuel injection valve via a transverse further throttle bore in the valve body. An annular chamber connected to the high-pressure part and running around the valve body is delimited at the top by a valve seat cooperating with the valve body.

When the nozzle needle is in the closed position, the control piston has a clearance in relation to the valve body, whereas, when the nozzle needle is in the open position, the control piston abuts the lower end face of the valve body. Immediately after the closing of the control valve, on the one hand, a pressure build-up initially occurs in the additional chamber through the transverse throttle bore, and, consequently, the valve body is moved toward the control piston and therefore brings about an automatic opening of the valve seat. As a result of this opening, an additional inflow of the control medium which is under high pressure flows into the additional chamber, with the result that the nozzle needle is brought into the closing position at increased speed by the valve body. After the closing position is reached, the valve body is moved back upward again by virtue of the pressure build-up in the control chamber and with spring-force assistance, until said valve body comes to bear on the valve seat.

EP-A-1 118 765 discloses a fuel injection valve for internal combustion engines, of which the needle-like injection-valve member has a stepped control piston which engages into a sleeve supporting a compression spring acting, as a closing spring for the injection valve. On the side facing away from the spring, the sleeve is supported an a control body which is arranged firmly in a housing of the fuel injection valve. The sleeve has a widening formed by a shoulder. In this widening, a sleeve-shaped valve body is arranged, a gap being present between the latter and the sleeve. The valve body interacts by its axial, end faces, on the one hand, with the shoulder, and on the other band, with the control body, the length of the valve body being slightly smaller than the clearance between the shoulder and the control body, so that the valve body can move back and forth in the axial direction over a small stroke. That part of the control piston which has a smaller diameter is guided in a narrow slitting fit in the valve body. Between that end of the valve body which faces away from the control body and that part of the control piston which has a larger diameter, an annular space is formed, which is connected to a high-pressure space arranged inside the housing and fed with fuel via a high-pressure inlet, via a gap which is formed between the corresponding part of the sleeve and that part of the control piston which has a larger diameter. A control space is delimited, on the one hand, by the control piston and, on the other hand by the control body and circumferentially by the sleeve-shaped valve body. A control passage having a narrowing acting as a throttle runs through the control body from the end face delimiting the control space to the apposite end face which delimits a low-pressure space. The control passage can be connected to the low-pressure space and can be separated from the latter by means of an electromagnetically actuated pilot valve.

A fuel injection valve is disclosed in EP-A-0 426 205. In this fuel injection valve, the control space is delimited circumferentially by the housing at the fuel injection valve and, as seen in the axial direction, on the one hand, at a double-acting control piston of the injection-valve member and, at the other hard, by an intermediate valve body, which leaves free an annular gap between itself and the housing, and the control body delimiting the annular gap and arranged firmly in relation to the housing. A compression spring is arranged between the control piston and the intermediate valve body. A stepped bore which exerts a throttle action runs through the intermediate valve body in the axial direction. A further bore runs, in the prolongation of this bore, through the control body and can be connected to a low-pressure space and separated from the latter by means of an electromagnetically actuated pilot valve. An additional bore issues into this bore running in the axial direction, in the control body, and is connected to a circumferential annular groove which is located in the control body and which is itself connected to the high-pressure inlet of the fuel injection valve. A plurality of bores run from this annular groove to that end face of the control body which faces the intermediate valve body. These bares are closed by the intermediate valve body when the latter comes to bear on the control body.

The disclosure of each of the above-noted prior art patents is herein incorporated by reference.

SUMMARY OF THE INVENTION

An object of the present invention is to provide a generic fuel injection valve which in each case is quickly ready for a further injection operation.

This object is achieved by means of a fuel injection valve having the features claimed in the present application. In addition to its simplicity, the fuel injection valve according to the invention is at the same time extremely compact. It requires, in particular, only a small amount of space in diameter. With the possibilities afforded by the injection valve according to the invention, the properties of the fuel injection valve can be designed in a simple way to match the requirements. In particular, the fuel injection valve according to the invention is in each case ready again very quickly for a further injection operation. By virtue of the available damping possibilities, a very long useful life can be achieved. Further advantages may be gathered from the (allowing description of the exemplary embodiments.

Preferred embodiments are specified in the specification and claims and includes a further particularly simple embodiment of a fuel injection valve.

BRIEF DESCRIPTION OF THE FIGURES

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
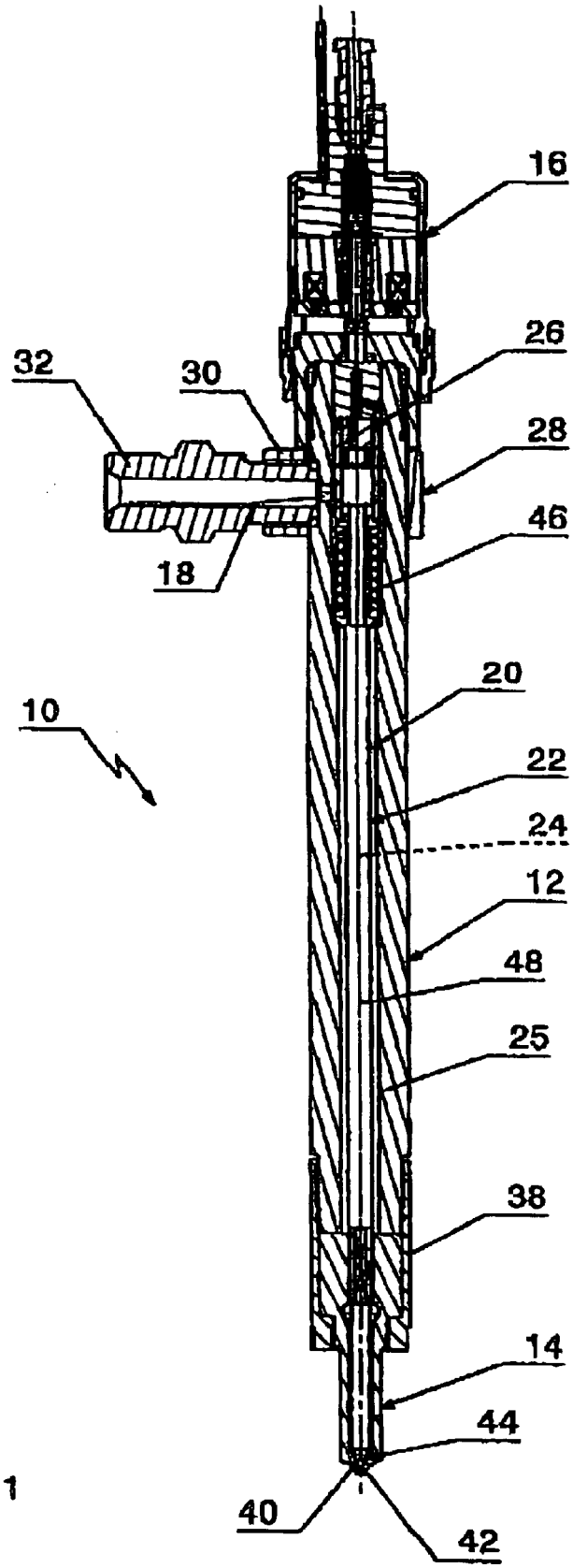
FIG. 1 shows a fuel injection valve in longitudinal section.

FIG. 1 shawl an axial section through a fuel injection valve 10. The latter has a tubular housing 12, to which a valve-seat element 14 is fastened at one end and an electromagnet arrangement 16 for the electromagnetic control of the fuel injection valve 10 is fastened at the other end. The housing 12 has a bore which serves as a high-pressure inlet 18 and runs in the radial direction and through which fuel is introduced under high pressure (i.e., 200–2000 bar or more) into a housing-delimited high-pressure space 20 which extends in the axial direction as far as that end of the housing 12 which is located on the same side as the valve-seat element. Located in this high-pressure space 20 is a needle-like injection-valve member 22, the axis 24 of which coincides with the axis of the hollow-cylindrical housing 12. The valve-seat element 14 is flow-connected to the high-pressure inlet 18 by means of an annular space 25 present between the housing 12 and the injection-valve member 22. Also located inside the tube-like housing 12 is a hydraulic control device 26 for the injection-valve member 22. This control device will be described in greater detail further below in connection with FIGS. 2 and 4.

The housing 12 passes through a connection collar 28 having a threaded flange 30 which projects in the radial direction and into which is screwed a high-pressure connection piece 32. As may be gathered particularly from FIG. 2, the wall of the high-pressure connection piece 32 is designed to be narrowed conically in the end region facing the housing 12, so that the width of the end-face annular sealing surface 34 is smaller than the thickness of the wall of the high-pressure connection piece 32 at the remaining points, as a result of which, when the high-pressure connection piece 32 is tightened, high surface pressure and therefore a connection tight under high pressure is obtained between the sealing surface 34 and the countersealing surface 36, cooperating with it, on the housing 12. The high-pressure inlet 18 of the housing 12 is located in the middle of the countersealing surface 36. The connecting collar 28 is fastened to the housing 12 by means of the high-pressure connection piece 32. It may be mentioned, in this respect, that the housing 12 may have a shoulder on the outside for the axial positioning of the connection collar 28. In a variant, not shown, the high-pressure connection piece 32 has a conical narrowing on its outside, with the same effect as in the case of the narrowing shown on the inner wall of the high-pressure connection piece 32. The high-pressure connection piece 32 may also be pressed onto the sealing surface 34 by means other than a thread.

As may be gathered from FIG. 1, the valve-seat element 14 is fastened to the housing 12 in a known way by means of a union nut 38. Injection-nozzle holes 42, which issue into the high-pressure space 20, run in a known way from the sonically designed free outer end face 40 of the valve-seat element 14. A likewise conically shaped inner end face of the valve-seat element 14 is designed as a valve seat 44 and is intended to cooperate with the matching end region of the injection-valve member 22. When the injection-valve member 22 is in the closing position, this end region separates the injection-nozzle holes 42 from the high-pressure space or connects them to the latter when said injection-valve member 22 is lifted off from the valve seat 44 in the injection position.

Figures 2, 3A, 3B:
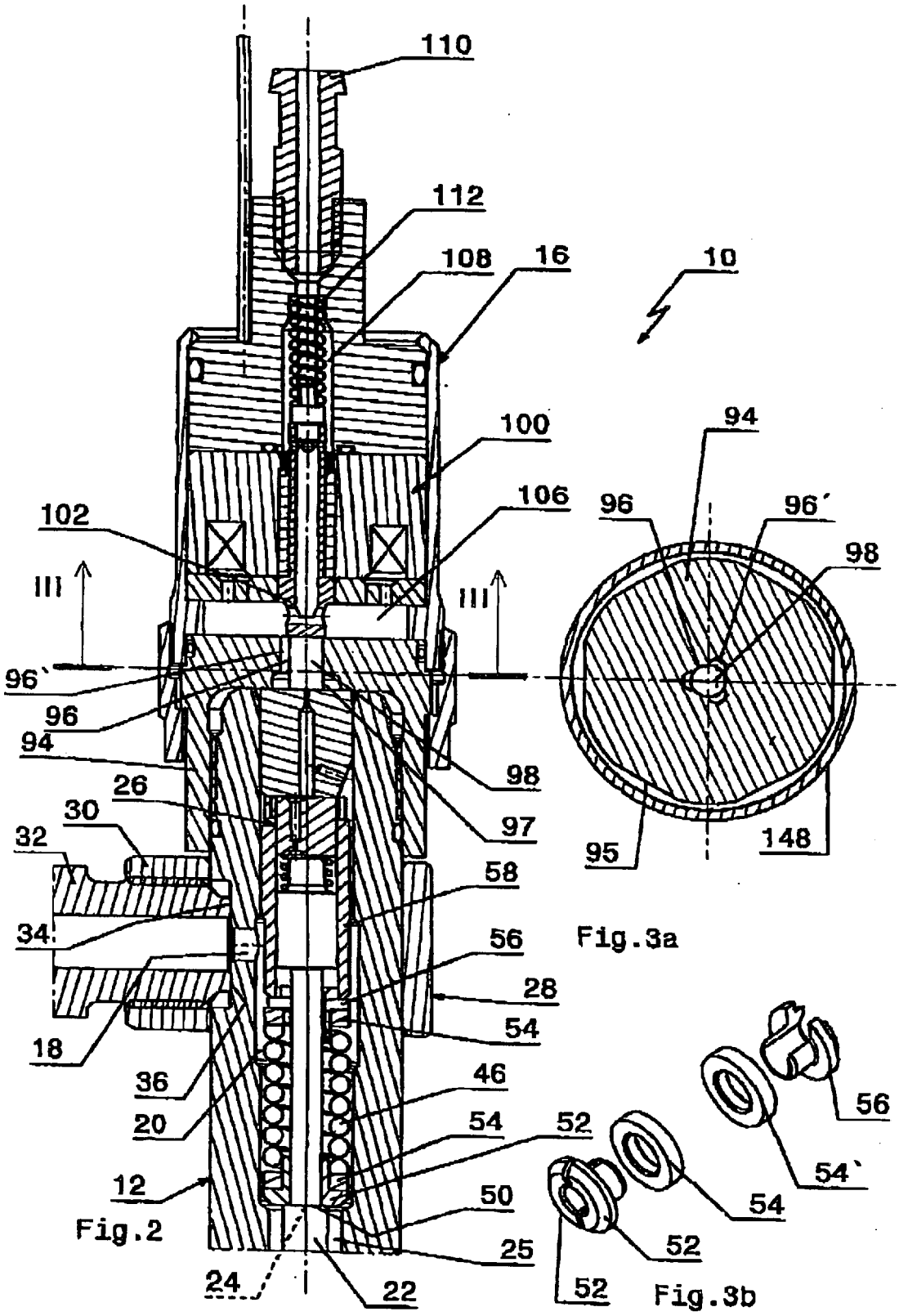
FIG. 2 shows, likewise in longitudinal section and enlarged with respect to FIG. 1, part of the injection valve shown therein, with the control device and with the electromagnetic arrangement.
FIG. 3*a* shows a cross section through the injection valve, said cross section being designated by III—III in FIG. 2.
FIG. 3*b* shows a perspective illustration of parts for supporting the closing spring of the fuel injection valve.
Figure 4:
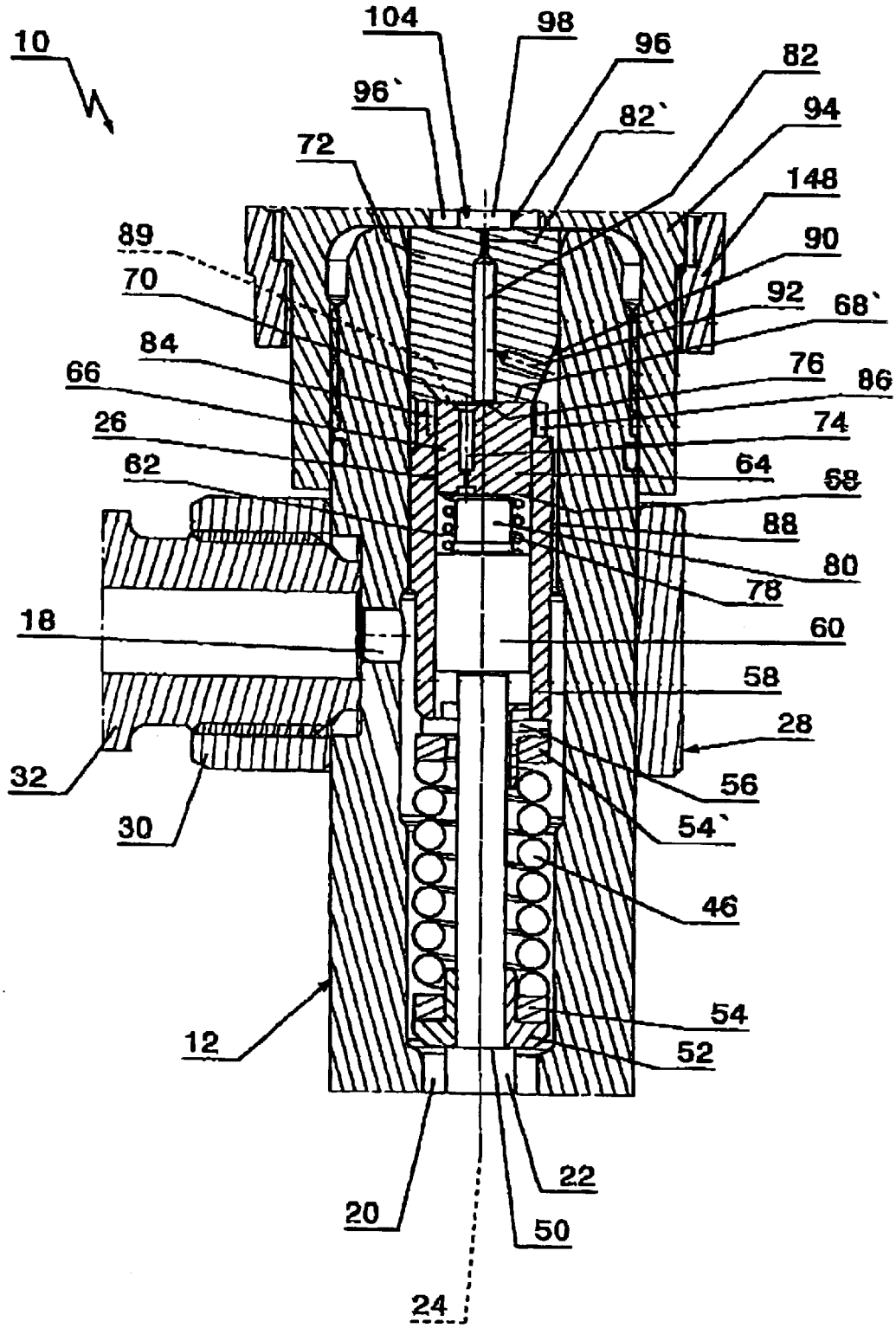
FIG. 4 shows, in longitudinal section and enlarged with respect to FIGS. 1 and 2, part of the fuel injection valve shown therein, with the control device.

As shown, enlarged with respect to FIG. 1, in FIGS. 2 and 4, the injection-valve member 22 is prestressed in the closing direction by means of a closing spring 46 designed as a compression spring. The shank 48 of the injection-valve member 22 has a shoulder 50, on which are supported (cf. FIG. 3*b*) two supporting half flanges 52 which, in the assembled state, are surrounded and held together by a first ring 54. One end of the closing spring 46 is supported on this first ring 54. The other end is supported on a second ring 54' which is seated an a one-piece supporting flange 56 having a slot. This supporting flange, in turn, bears on the end face of an essentially hollow-cylindrical sleeve 58 which will be described in greater detail in connection with the control device 55. That part of the injection-valve member 22 which is somewhat narrowed in diameter after the shoulder 50 passes with marked play through the supporting flange 56, while the supporting half flanges 52 axe preferably seated, virtually free of play on the injection-valve member 22. Since the wall of the sleeve-shaped part of the supporting half flanges 52 can be made thin, it is possible for the closing spring 46 to have a very slender design in terms of its inside diameter; the latter may correspond approximately to the outside diameter of the injection-valve member 22 below the shoulder 50. Furthermore, the sleeves 54, 54' may be used for the equalization or compensation of length deviations. By the choice of sleeves 54, 54' of different thickness, the force of the closing spring 46 subjected to production tolerances and belonging to a series of fuel injection valves can always be kept the same.

The control device 26 is described with reference to FIG. 4. It can be seen from this that the injection-valve member 22 has, in its end region facing away from the valve-seat element 14, a double-acting control piston 60 which is guided in the sleeve 58 in a narrow sliding fit, that is to say with a play of about 3 to 10 $\mu$m. The control piston 60 delimits, on the one hand, the high-pressure space 20 and, on the other hand, a control space 62 which is delimited circumferentially by the sleeve 58. Furthermore, a slide-valve body 64 of a slide valve 66 is arranged in the sleeve 58 in a narrow sliding fit and is guided freely moveably in the direction of the axis 24. A first end face 68 facing the injection-valve member 22 likewise delimits the control space 62. A second end face 68' facing away from the first end face 66 is designed as a sealing surface and is intended, when the slide-valve body 64 is in a sealing position, to come to bear sealingly on one end face, designed as a slide-valve seat 70, of a control body 72 which is arranged firmly in the housing 12, for example by means of a shrinkage connection.

A throttle passage 74 runs, arranged eccentrically with respect to the axis 24, through the slide-valve body 64 from the first end face 68 to the second end face 68'. A hydraulic connection 76 is cut out in the slide-valve body 64 on the second end face 68' and runs on such side conically widened mouth of the throttle passage 74 in the radial direction toward the axis 24 and beyond the latter. However, the connection 76 is surrounded on all sides by a projecting edge. The hydraulic connection 76 is advantageously configured in such a way that the recessed surface is of a defined amount, in order to achieve an optimum response for the slide valve 66 far terminating the injection operation.

In a variant, not shown, the throttle passage 74 is arranged on the axis 24. In this case, the hydraulic connection 76 is dispensed with.

Arranged in the control space 62 is a spring element 78 which is designed as a compression spring and which is supported, on the one hand, on the control piston 60 and, on the other hand, on the slide-valve body 64. The spring element surrounds a central projection 80 of the control piston 60 and the farce generated by said spring is substantially lower than that of the closing spring 46.

The control body 72 has a control passage 82 which runs coaxially to the axis 24 and which has a throttle contraction 82' in an end region facing away from the slide-valve body 64. The hydraulic connection 75 connects the control passage 82 to the throttle passage 74, even when the slide-valve body 64 bears sealingly on the control body 74, The sleeve 58 is supported, on the end face, on the control body 72. On that end region of said sleeve which faces the control body 72, there is, on the radially inner side, a peripheral recess 94 which, when the slide-valve body 64 is in the sealing position, forms with the latter an annular groove which is connected to the high-pressure space 20 via a slot 86 in the sleeve 58 and by at least one flow gap 88 which runs in the axial direction and which is formed between the inner wall of the housing 12 and a flattened portion on the outside of the sleeve 58. As a result, a gap 89, which is formed when the slide-valve body 64 moves away from the control body 72, is also connected to the high-pressure space 20, and the entire second end face 68' of the slide-valve body 64 is acted upon by high pressure. The control body 72 has an oblique surface 90, from which a throttle inlet 92 leads into the control passage 82, in order to connect the latter permanently to the high-pressure space 20.

The throttle inlet 92 issues into the control passage 82 between the throttle contraction 82' and the slide-valve seat 70. A throttle contraction arranged at 90° to the axis 24, with a ground-down surface in the control body or with an annular groove on the control body, could also be used. The cross sections of the recess 84, of the slot 86 and of the flow gap 88 are configured so as to be substantially larger than the cross sections of the throttle passage 74, of the throttle contraction 82' and of the throttle passage 92, so that no appreciable throttlings occur, and the pressure in the recess 84, in the slot 86 and in the flow gap 88 is essentially equal to that in the high-pressure inlet 18 and in the high-pressure space 20.

As may be gathered from FIG. 4 and, in particular, also from FIGS. 2 and 3*a*, a further union nut 94 is screwed onto the tubular housing 12, from the side of the electromagnet arrangement 16, and has centrally a passage bore 96 with three longitudinal grooves 96' distributed in the circumferential direction. A valve pin 98 is arranged displaceably in the axial direction anal guided radially in the passage bore 96. On the control-body side, the passage bore 96 has a widening recess 97 which assists the outflow of the fuel, relieved by the throttle contraction 82' during injection, into the longitudinal grooves 96'. Instead of the longitudinal grooves 96', one or more bores could also be used, which connect the recess 97 to the low-pressure space 106. In this case, the bore 96 would guide the valve pin 98 radially over the entire circumference. The union nut 94 has a hexagon 95 (cf. FIG. 3*a*), by means of which it can be tightened with the necessary tightening torque. Further tensioning means, not shown, may likewise be used.

Figure 10:
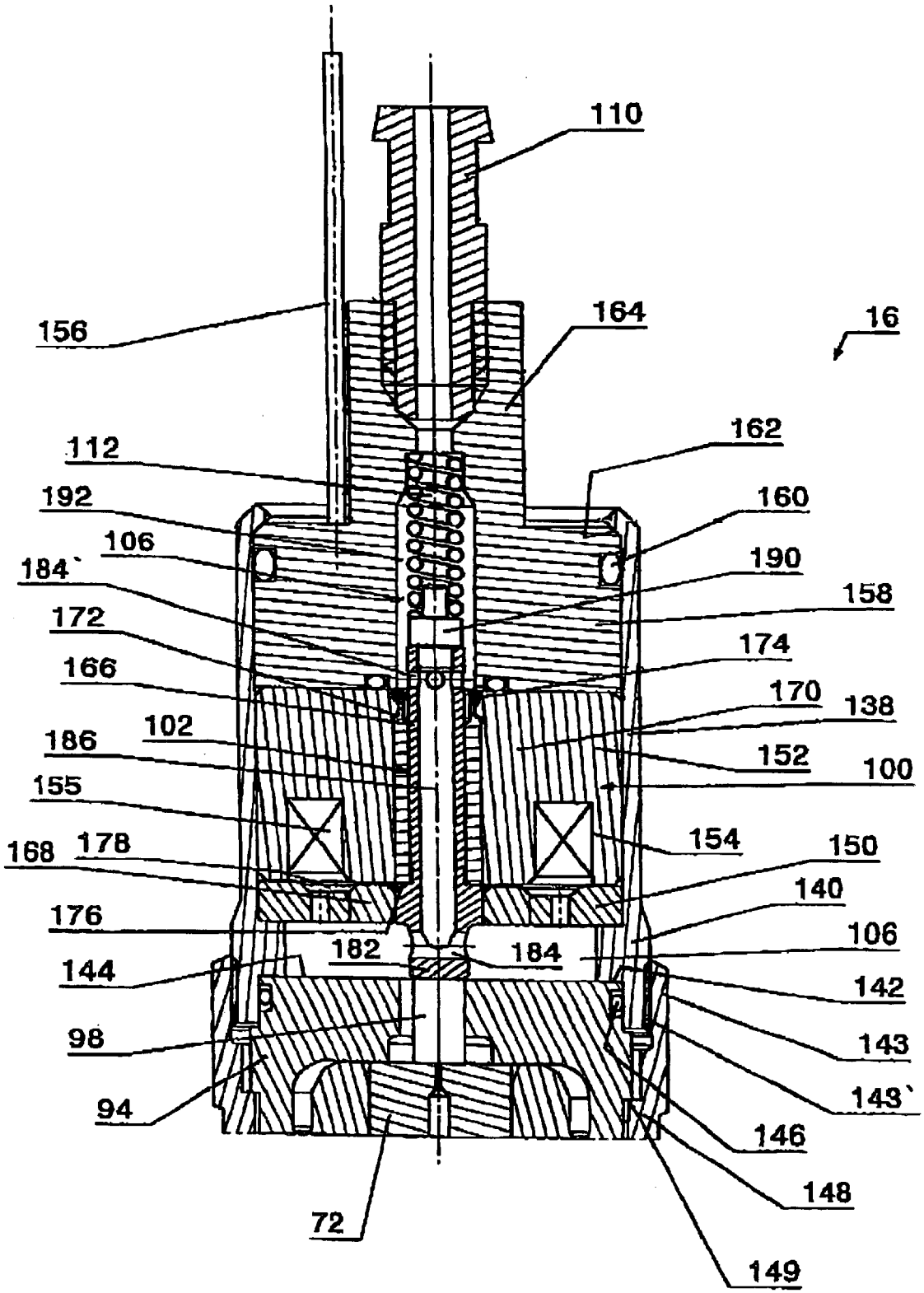
FIG. 10 shows, in longitudinal section and enlarged with respect to FIGS. 1 and 2, part of the fuel injection valve shown there, with the electromagnet arrangement.

The union nut 94, on the one hand, retains the control body 72, which, as appropriate, is pressed in only slightly in the housing 12, against the pressure in the high-pressure space 20 and positions said control body exactly. On the other hand, further important functions, which are explained further below and in the description of FIG. 10, are allocated to the union nut 94.

When the electromagnet 100 of the electromagnet arrangement 16 is not excited, the valve pin 98 is held by an armature 102 of the electromagnet arrangement 16 in bearing contact against the control body 72, where said valve pin closes the control passage 82. The valve pin 98, together with the control body 72, forms a pilot valve 104. Located on that side of the further union nut 94 which faces away from the control body 72 and the hauling 12 is the low-pressure space 106 which is flow-connected to a low-pressure outlet connection piece 110 by means of connecting ducts 108 in the electromagnet arrangement 16. A line leads in a known way from the low-pressure outlet connection piece 110 back to a fuel reservoir.

The armature 102 is acted upon by the force of an armature spring 112 which is designed as a compression spring and which, when the electromagnet 102 is not excited, holds the valve pin 98 in bearing contact against the control body 72 via the armature 102. When the electromagnet 100 is excited, the latter pulls the armature 102 back counter to the force of the armature spring 112, with the result that the valve pin 98 can lift off from the control body 72.

The embodiment of the fuel injection valve 10 shown in FIGS. 1 to 4 functions as follows. The starting state is the state which is shown in said Figures and in which the injection-valve member 22 is in the closing position and the slide valve 66 is in the sealing position on the slide-valve seat 70. Furthermore, the electromagnet 100 is not excited, so that the valve pin 98 closes the control passage 82 , The same pressure is present in the control space 62 as in the high-pressure space 20.

An injection cycle is triggered by the excitation of the electromagnet 100. At the same time, the armature 102 is attracted, with the result that the valve pin 98 can lift off from the control body 72 and the control passage 74 is thereby connected to the low-pressure space 106. Since the throttle contraction 82' has a larger flow cross section than the throttle inlet 92, the pressure in the control space 62 begins to fall. The injection-valve member 22 consequently moves away from the valve seat 44 and releases the injection-nozzle holes 42. The injection operation then commences. In this case, fuel is displaced out of the control space 62 through the throttle passage 74, the hydraulic connection 76 and the control passage 82 into the low-pressure space 106. During the entire operation of opening the injection-valve member 22, the slide-valve body 64 remains in bearing contact against the control body 72. The opening strobe of the injection-valve member 22 is limited in that the projection 80 of the injection-valve member 22 comes to bear on the slide-valve body 64, the throttle passage 74 remaining exposed. Since the narrowest flow cross section of the throttle passage 74 is smaller than the cross section of the throttle contraction 82', the opening movement of the injection-valve member 22 is mainly determined, for a given pressure and given closing spring 46, by the throttle passage 79.

In a variant, not illustrated, the throttle passage 74 is positioned and the end face of the projection 80 configured in such a way that the throttle passage 74 is closed by the projection 80 toward the end of the opening stroke. This is due, for example, to the fact that the throttle passage 74 is positioned an the axis 24 and the end face of the projection 80 is made sealing. Consequently, the end of the opening stroke is advantageously damped and the pressure in the control space 62 after the end of the opening movement is not or not entirely matched to the lower pressure in the control passage 82.

To terminate the injection operation, the electromagnet 100 is de-excited. The result of this is that, under the force of the armature spring 112, the armature 102 displaces the valve pin 98 into bearing contact against the control body 72. The low-pressure-side mouth of the control passage 82 is closed. As a result of the connection by the throttle inlet 92 to the high-pressure space 20, the pressure in the control passage 82 begins to rise, which, because of the pressure difference on the two end faces 68, 68' of the slide-valve body 64 and the corresponding effective surfaces, leads to a movement of the slide-valve body 64 away from sealing bearing contact against the control body 72, so as to form the gap 89. The closing spring 46 simultaneously causes a movement of the injection-valve member 22 in the direction of the valve seat 44. The result of the under-pressure in the control space and of the high pressure on the second end face 68' is that the slide-valve body 64 mores in the manner of a tandem movement together with the injection-valve member 22, until the latter closes the valve seat 44 and thereby terminates the operation of injection into the combustion space of the internal combustion engine.

As a result of the follow-up flow of fuel through the throttle passage 74 into the control space 62, the pressure in the latter gradually matches the pressure in the high-pressure space 20, with the result that the slide-valve body 64 moves back into the sealing position under the force of the spring element 78. The fuel injection valve is then ready for the next injection operation.

Figure 5:
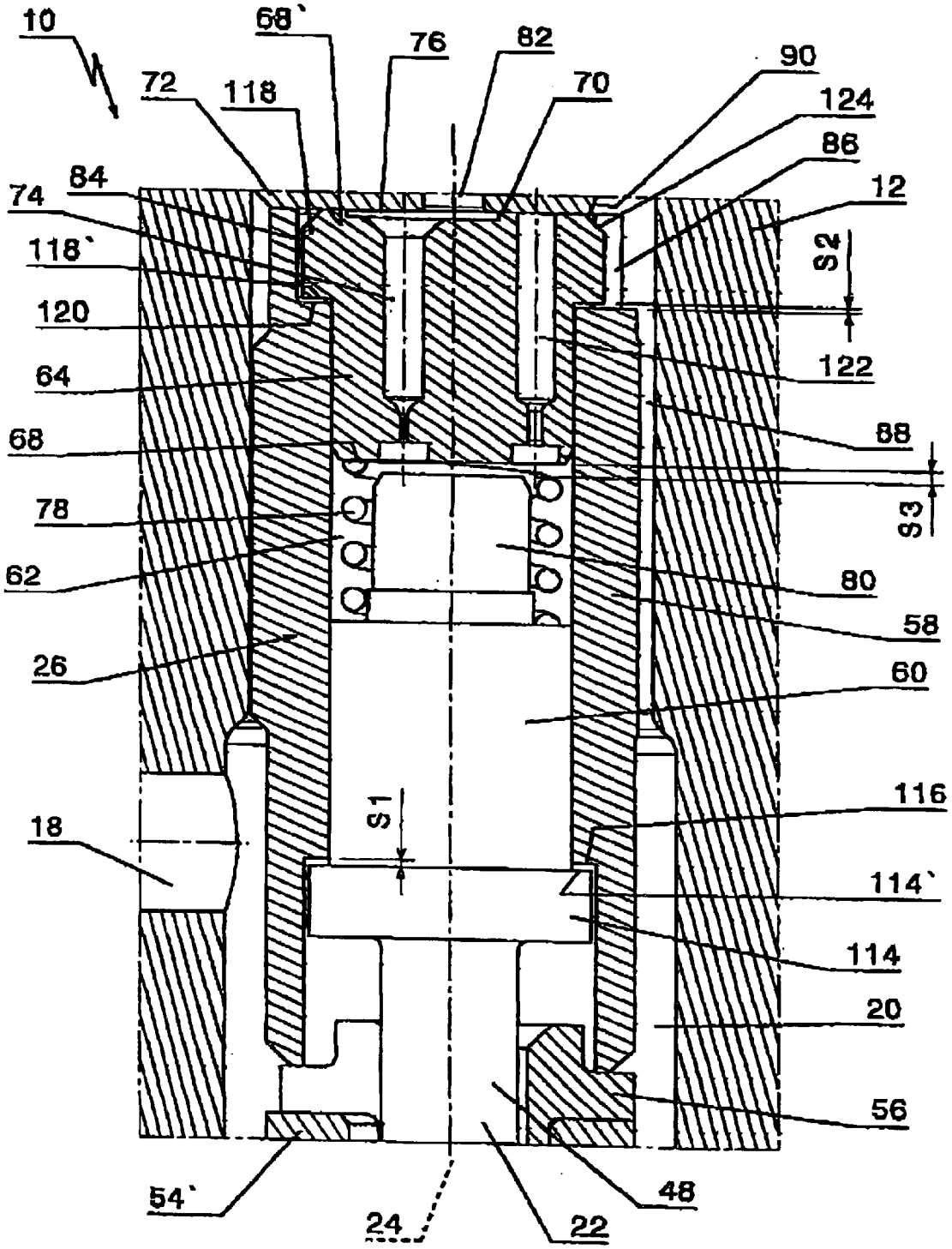
FIG. 5 shows, in the same illustration as FIG. 4, a first embodiment of the control device according to the invention.

The hydraulic efficiency of this fuel injection valve 10 is very high. Only a small amount of fuel is consumed for the control, thus leading to an insignificant return flow of fuel into the low-pressure reservoir. Furthermore, as compared with embodiments of fuel injection valves disclosed, for example, in EP-A-1 118 765, the coaxiality of the injection-valve member 22 to the slide valve 66 plays no part, thus leading to good movement properties both of the injection-valve member 22 and of the slide-valve body 64. FIG. 5 shows a first embodiment according to the invention of the control device 26. The fuel injection valve 10 is otherwise designed in the same way as shown in FIGS. 1 to 4 and as described further above. Only the differences from that embodiment are dealt with below. The same reference symbols are used far identical arid identically acting parts.

The control piston 60 has, in its end region facing the high-pressure space 20, a peripheral bead 114 with a stop shoulder 114'. The latter is intended fax cooperating with a counterstop shoulder 116 integrally formed an the sleeve 58. The bead 114 otherwise does not touch the sleeve 58. When the injection-valve member 22 is in the closing position, the stop shoulder 114' and the counterstop shoulder 116 are at a distance from one another by the amount of a clearance $S_1$. A further bead 118 is integrally formed circumferentially an the slide-valve body 64 and forms a further stop shoulder 118'. The latter is intended for cooperating with a further counterstop shoulder 120 formed an the sleeve 58. Said counterstop shoulder is formed by the axial boundary of the recess 84. When the slide-valve body 64 is in the sealing position, the clearance between the further stop shoulder 118' and the further counterstop shoulder 120 has a length $S2_2$. $S_3$ designates the clearance between the projection 80 of the injection valve 22 and the slide-valve body 64 when the slide-valve body 64 is in the sealing position and when the injection-valve member 22 is in the closing position. The gaps formed by these clearances $S_1$, $S_2$ and $S_3$ are designed in such a way that the gap designated by $S_1$ is larger than that designated by $S_2$ and smaller than that designated by $S_3$.

The slide-valve body 64 has a further throttle passage 122 which extends between the first and the second end face 68, 68' and which is closed by the slide-valve seat 70 on the control body 72 when the slide-valve body 64 is in the sealing position. With the slide-valve body 64 lifted up from the control body 72, the further throttle passage 122 connects the control space 62 to the high-pressure space 20 in parallel with the throttle passage 74.

Furthermore, the slide-valve body 64 has, an the side facing the control body 72, a chamfer 124, by means of which the active surface, acted upon by high pressure, of the valve-slide body 64 can be selected according to size. The circular diameter at the outer edge of the slide-valve seat 70 may therefore also be larger than, equal to or smaller than the guide diameter of the slide valve 64 in the sleeve 58.

Upon commencement of injection operation and as long as the pilot valve 104 is open, the further throttle passage 122 does not exert any action, and the injection-valve member 22 opens in the same way as in the embodiment according to FIGS. 1–4, until the stop shoulder 114' then touches the counterstop shoulder 115 and terminates the opening operation. Since $S_3>S_1$, the end face of the projection 80 does not touch the first end face 68 of the slide-valve body 64. In embodiments with a stop shoulder 114' on the injection-valve member 22 and with a counterstop shoulder 116, the situation can be avoided where the injection-valve member 22 butts against the slide-valve body 64 during the opening of the fuel injection valve 10. The useful life can thereby be prolonged.

Only during the closing of the pilot valve 104 and the associated lifting of the slide-valve body 64 off from the slide-valve seat 70, in the same way as described further above, is the further throttle passage 122 released, with the result that more rapid pressure equalization takes place between the control space 62 and high-pressure space 20 than in an embodiment without a further throttle passage 122. This leads to an earlier and quicker movement of the slide-valve body 64 bank into the sealing position. In other words, the fuel injection valve 10 is ready more quickly for a further injection operation, thus making preinjection, postinjection or multiple injection possible at short time intervals. The return movement of the slide valve 66 can be set according to the requirements by virtue of the dimensioning of the further throttle passage 122.

The slide-valve body 64 in the embodiment of the fuel injection valve 10 according to FIGS. 1 to 4 may also have a further throttle passage 122 similar to FIG. 5.

Stroke limitation for the slide-valve body 54 by the further stop shoulder 118' and the further counterstop 120 leads to the slide-valve body 64 resuming its sealing position very quickly, since $S_2<S_1$. The tandem movement of the slide-valve body 64 and injection-valve member 22 is canceled as soon as the further stop shoulder 118' comes to bear on the further counterstop shoulder 120. At the same time, by means of this measure, the impact of the injection-valve member 22 on the valve seat 44 can advantageously be damped as a result of the refilling of the control space 62, said refilling being throttled, without the tandem movement, via the throttle passage 74 and the further throttle passage 122. All these measures may also be taken independently of one another in the remaining embodiments. In the second embodiment, shown in FIG. 6, of the fuel injection valve 1*b* according to the invention, the same reference symbols as in the embodiments described further above are likewise used, and only the differences from these embodiments are dealt with.

The control body 72 is in this case no longer seated in the tubular housing 12, but is placed onto the latter on the end face and is held centrally by means of a corresponding recess in the further union nut 94 and is sealingly pressed against the upper end of the tubular housing 12. The control passage 82 runs centrally and in the axial direction through the control body 72. Here, however, the throttle inlet 92 is located in the slide-valve body 64. The throttle inlet issues into the throttle passage 74, specifically on the side facing the control body 72 with respect to the narrowest cross section. Furthermore, the throttle inlet 92 communicates with the high-pressure space 20 via the recess 84, the gap 86 and the flow gap 88.

Figure 6:
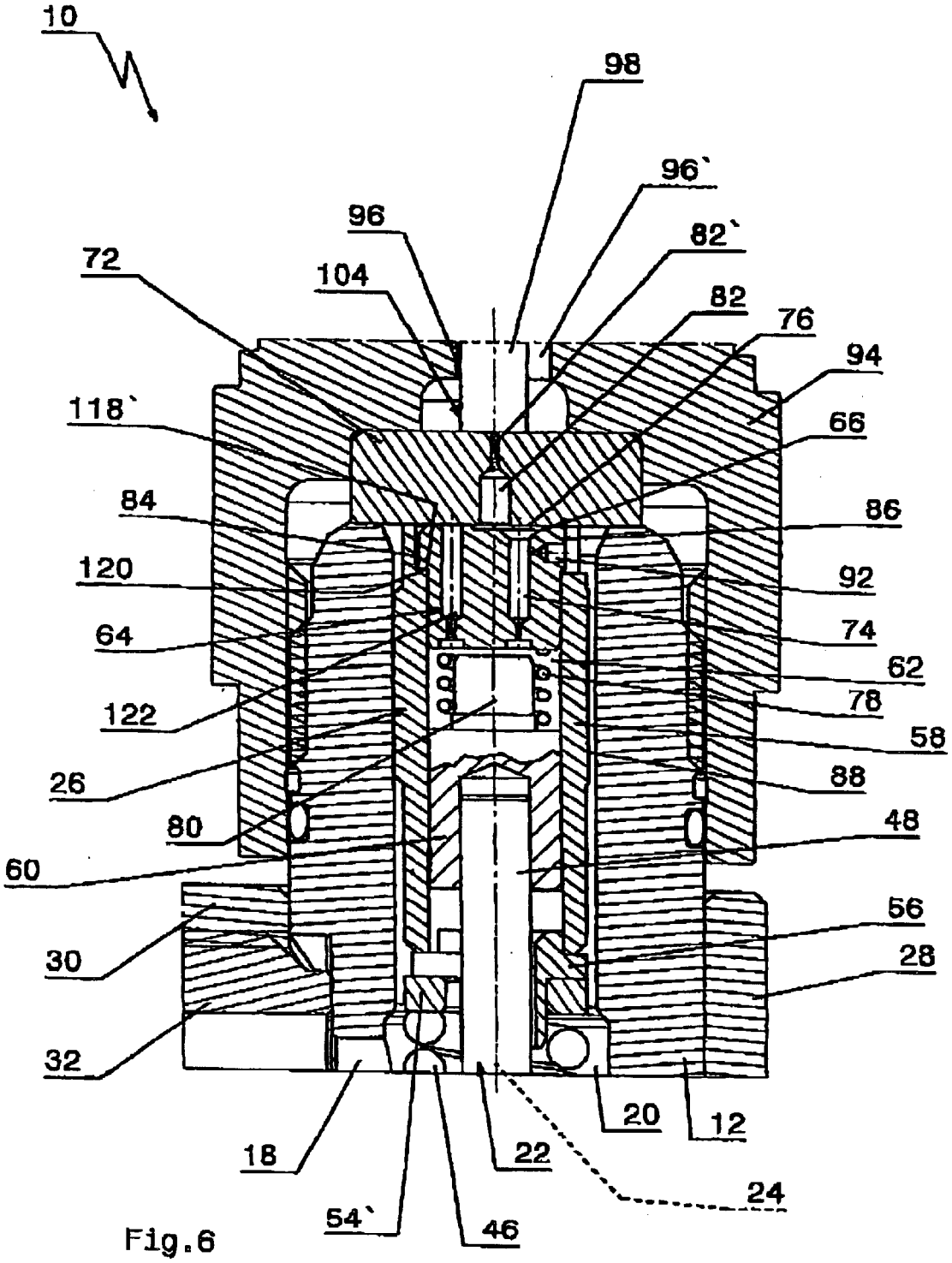
FIG. 6 shows, in the same illustration as FIGS. 4 and 5, a second embodiment of the control device designed according to the invention.

The slide-valve body 64 shown in FIG. 6, like that of the embodiment according to FIG. 5, is equipped with a further throttle passage 122 and with a further stop shoulder 118' which cooperates with the further counterstop shoulder 120 on the sleeve 58.

FIG. 6 shows a further possibility for designing the injection-valve member 22, in that, to be precise, the control piston 60 and the shank 48 are produced as individual parts. The connection between these parts may be made, for example, by means of a press fit, by a narrow fit or by means of welding. The shank 48 may also pass through the control piston 60. In this case, the projection 80 is formed by the upper end of the shank 48, and the control piston 60 is a sleeve with a continuous bore, which sleeve, as mentioned above, may be assembled together with the shank 48. The functioning of the embodiment, shown in FIG. 6, of the control device 26 is the same as in that according to FIG. 5.

Figure 7:
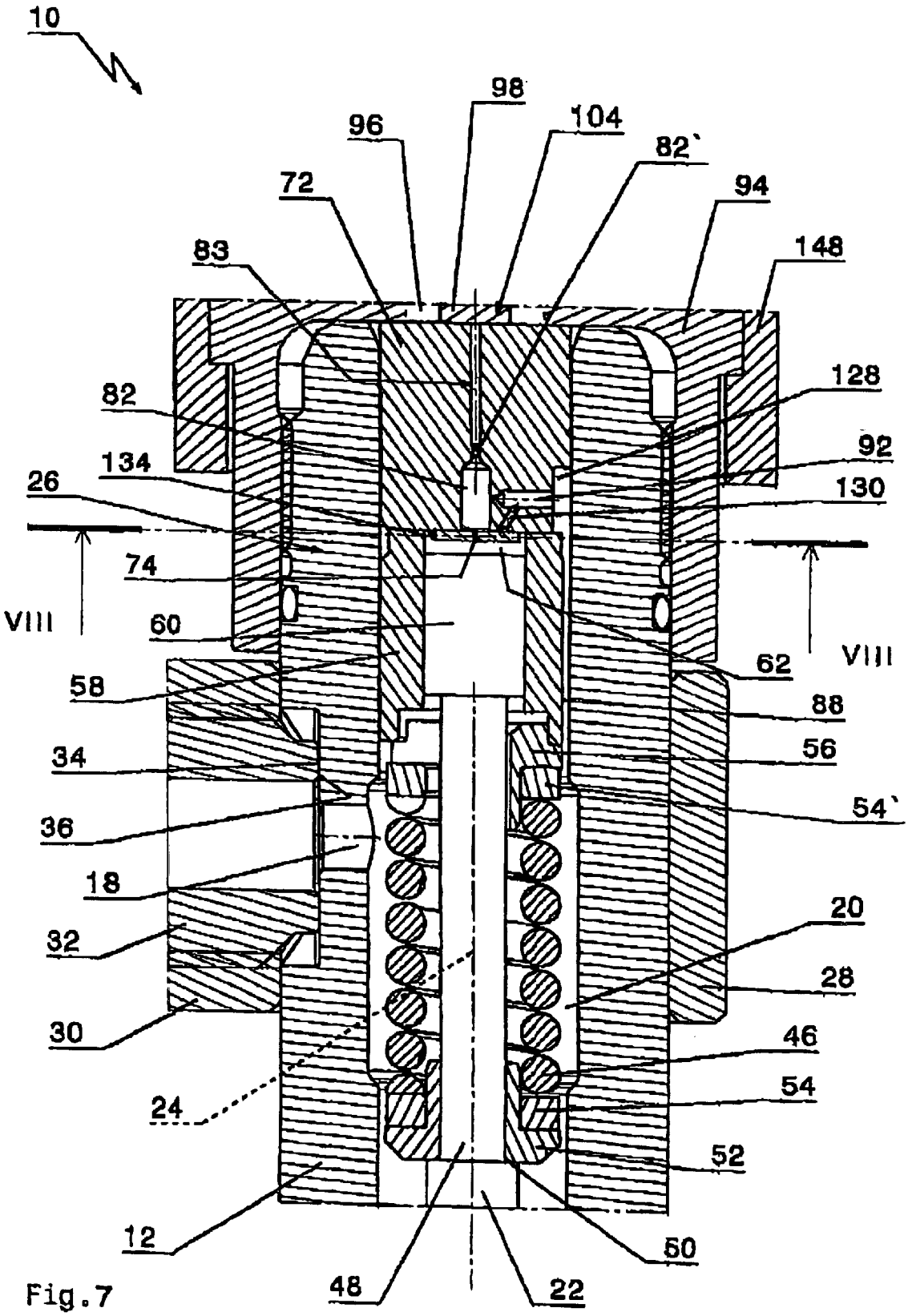
FIG. 7 shows, in the same illustration as FIGS. 4, 5 and 6, an embodiment of the control device for an injection valve which has a leaf-spring valve instead of a slide valve.
Figure 8A:
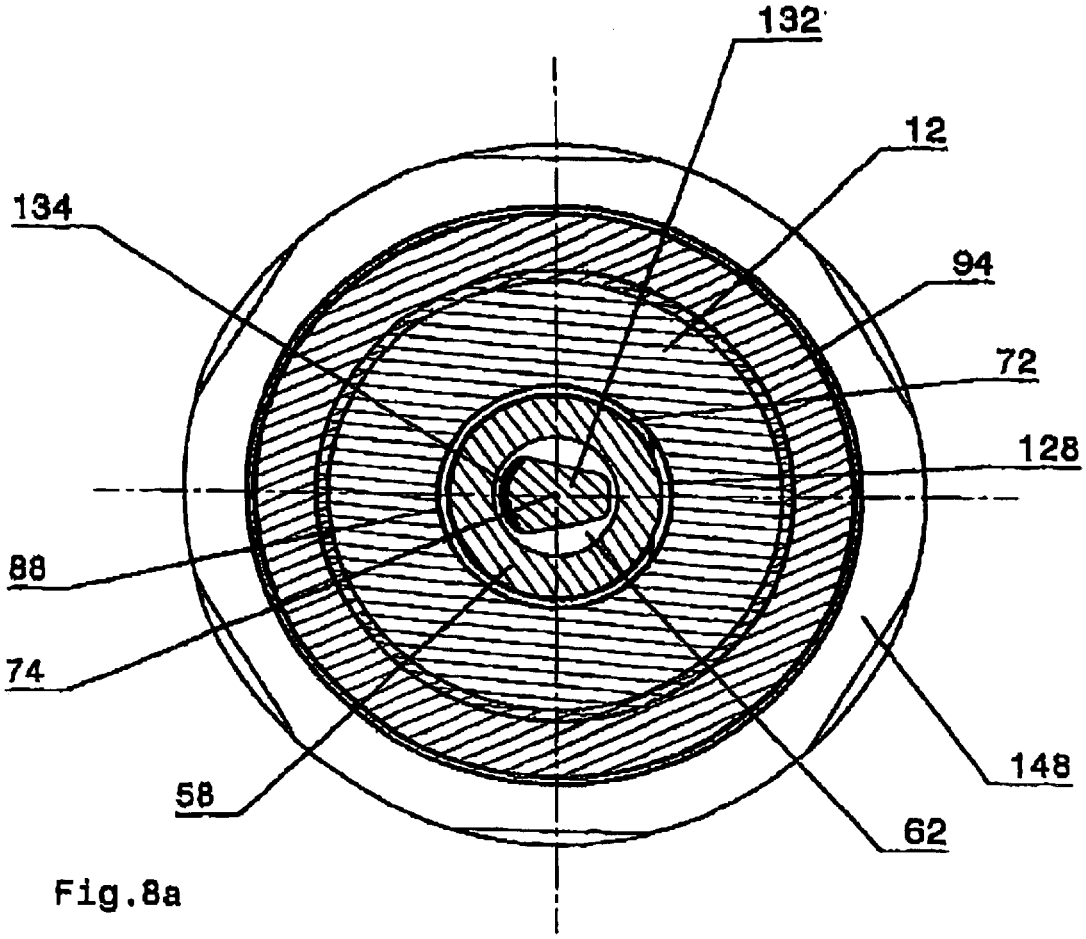
FIG. 8*a* shows a cross section, designated by VIII—VIII in FIG. 7, through that part of the fuel injection valve which is shown therein.
Figure 8B:
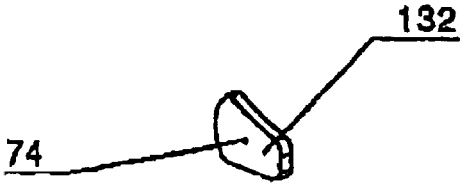
FIG. 8*b* shows a perspective illustration of the leaf spring used in the control device according to FIGS. 7 and 8*a;*

The embodiment shown in FIGS. 7*a* and 8*b* likewise has a tube-like housing 12, in which the control body 72 is arranged with a firm fit. With its end face facing the control space 62, the sleeve 58, in which the double-acting control piton 60 of the injection-valve member 22 is arranged moveably in the axial direction in a narrow fit, is in this case supported sealingly and without a hydraulic connection to the high-pressure space 20. As described further above, the closing spring 46 for the injection-valve member 22 is supported on the sleeve 58 on the side facing away froze the control body 72. The control space 62 is thus delimited, on the one hand, by the control piston 60, circumferentially by the sleeve 58, and, on the other hand, by the control body 72.

The control body 72 has centrally thereof, running in the direction of the axis 24, the control passage 82, into which issues the throttle inlet 92 running in the radial direction. The latter is connected to the high-pressure space 20 as a result of an outer milled portion 128 and the flow gap 88 between the sleeve 58 and the housing 12. A bore 130 runs from that end face of the control body 72 which faces the control space 62 through said control body to the throttle inlet 92. Said bore issues into the throttle inlet 92 on the side facing the high-pressure space 20 with respect to the narrowest flow cross section.

Both the control-space-side mouth of the control passage 82 and that of the bore 130 are covered by means of a leaf-spring-like tongue 132, the shape of which can be seen from FIGS. 8*a* and 8*b*. At the end facing away from the bore 130, the tongue 132 is welded to the control body 72. The weld is designated by reference number 134. The tongue 132 has a throttle passage 74 which is coaxial to the axis 24 and which connects the control space 62 to the control passage 82. Here too the throttle contraction 82' in the control passage 82 is larger in cross section than the narrowest cross section of the throttle inlet 92 and the cross section of the throttle passage 74. The narrowest cross section 82' of the control passage 82 is connected on the outlet side to a bore 83 having a somewhat larger cross section. The bore 83 is preferably relatively long, as compared with its diameter, at least 2 to 10 times as long. The flow downstream of the narrowest cross section 82' will therefore fill the full larger cross section 83 again, thus assisting the throughflow through the narrowest cross section 82' . The fuel injection valve is otherwise designed in the same way as shown in FIGS. 1 to 4.

The control device 26 according to FIGS. 7, 8*a* and 8*b* functions as follows. To describe the functioning of the fuel injection valve 10 having a control device 26 according to FIGS. 7, 8*a*, and 8*b*, the starting point is, as in connection with the embodiments described further above, the state of rest in which the injection-valve member 22 is in the closing position and the pressure in the control space 62 corresponds to the pressure in the high-pressure space 20. The pilot valve 144 is closed by the valve pin 98 conning to bear on the control body 72.

When the electromagnet 100 is excited (cf. FIG. 2), the valve pin 98 is lifted off from the control body 72 as a result of the high pressure prevailing in the control passage 82. The control passage 82 is thereby connected to the low-pressure space 106 (cf. FIG. 2). The pressure in the control passage 82 falls, as a result of which, because of the pressure difference, fuel flows through the throttle passage 74 out of the control space 62 into the control passage 82. As soon as the pressure in the control space 62 has fallen to an extent such that the under-pressure with respect to the pressure in the high-pressure space 20 is sufficient to overcome the force of the closing spring 46, the injection-valve member 22 moves away from the valve seat 44, with the result that the injection operation commences. When the electromagnet 100 is de-excited, the valve pin 98 comes to bear on the control body 72 again, as a consequence of which the control passage 82 is separated from the low-pressure space. On that side of the tongue 32 which faces away from the control space 62, the pressure in the control passage 82 rises, thus leading to the bending of the tongue 132 because of the widening of the control passage and the pressure in the bore 130. By the control passage 82 and the bore 130 being released, fuel then passes via a larger flow cross section into the control space 62, thus leading to a rapid pressure rise in the control space 62 and to the more rapid movement of the injection-valve member 22 toward the valve seat 44. The operating behavior of the fuel injection valve can be designed according to the requirements by virtue of the dimensioning of the corresponding passages arid the properties of the tongue 132.

In the embodiment according to FIG. 7, FIG. 8*a* and FIG. 8*b*, at the end of the opening operation of the injection-valve member 22 the end face of the control piston 60 touches the underside of the leaf-spring-like tongue 132 and keeps the latter pressed onto the underside of the control body 72. Unintentional uncontrolled opening of the tongue 132 and consequently of the bore 130 when the injection valve 22 is fully open is thus avoided. This solution is similar in this respect to the solution of FIGS. 1 to 4, in which the slide valve 66 is kept pressed down by the projection 80. In the embodiment according to FIGS. 7 to 8*b*, too, the end face of the control piston 60 or of a projection thereof may be configured in such a way that the throttle passage 74 is closed at the end of the opening stroke and the pressure in the control space 62 is not or not entirely matched to the lowest pressure in the control passage 82.

On the other hand, the control piston 60 could, in a similar way to what is shown in FIG. 5, have a peripheral bead which cooperates with its stop shoulder and with a counterstop shoulder, in order to limit the stroke of the injection-valve member 22 before the end face of the control piston 60 touches the underside of the tongue 132.

Figure 9A:
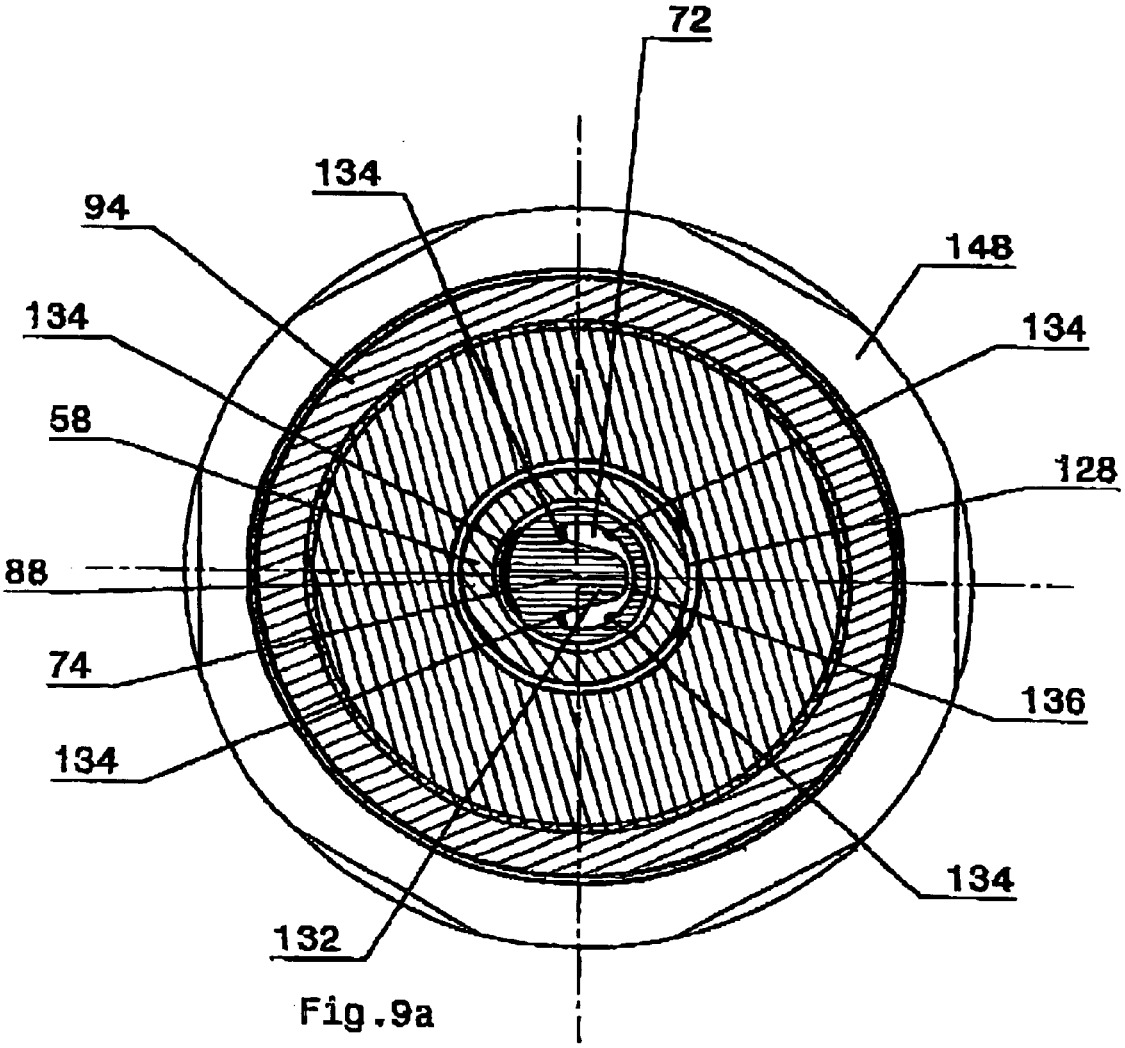
FIG. 9*a* shows, in a section corresponding to that of FIG. 8*a*, a further embodiment of the control device for an injection valve with a leaf spring.
Figure 9B:
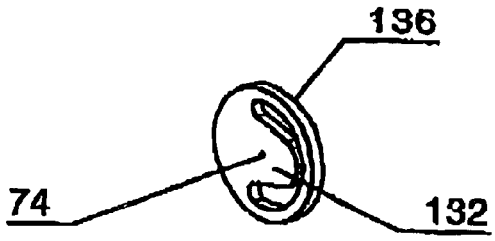
FIG. 9*b* shows a perspective illustration of the leaf-spring element in the injection valve according to FIG. 9*a*.

FIGS. 9*a* and 9*b* show, in the same illustration as FIGS. 8*a* and 8*b*, a section VIII—VIII according to FIG. 7 and the tongue 132 in a different embodiment. The tongue 132 is integrally formed in one piece on a holding ring 136. The holding ring 13 is welded to the control body 72 at one, preferably at a plurality of points, for example at the welds designated by 134. The leaf-spring element according to FIG. 9*b* can be produced in a sample manner by a C-shaped groove being punched out of a circular spring-steel disk. The functioning of the fuel injection valve 10 having a control device 26 according to FIG. 7, but with an embodiment of the tongue 132 according to FIGS. 9*a* and 9*b*, is the same as that described further above in connection with FIGS. 7, 8*a* and 8*b*.

As may be understood, in particular, from FIG. 10, together with FIGS. 2 and 3*a*, the electromagnet arrangement 16 has a housing sleeve 138 with a peripheral ring 140 integrally formed on the inside. The ring 140 defines a bearing surface 142 with which it bears on a plane outer surface 144 of the further union nut 94 in the assembled state. The axial position of the electromagnet arrangement 16 is thereby defined. A part 143 of the housing sleeve 138 which projects in the axial direction above the bearing surface 142 surrounds the further union nut 94, with the result that the radial position of the electromagnet arrangement 16 is also defined. An O-ring 146 seals off the low-pressure space 106 in relation to the surroundings. The further union nut 94 has running around it a threaded ring 148 which, on the one hand, is supported on a peripheral shoulder 149 of the further union nut 94 and, on the other hand, is screwed with its internal thread 149' to the housing sleeve 138 by means of are external thread 143'.

Seated on the ring 140, on the side facing away from the bearing surface 142, is an annular magnet return plate 150. Supported on the latter in the axial direction is a magnet body 152 which is likewise designed as, an annular body and which, on the side facing the magnet return plate 150, has an annular groove 154 encircling the axis 124. Located in said annular groove is the coil 155 which is connected to an electrical control means via electrical coil connection lines 156, only one of which is shown in FIG. 10.

Located on that side of the magnet body 152 which faces away from the magnet return plate 150 is a holding body 158 which may consist of an antimagnetic material. In a circumferentially arranged peripheral groove of the holding body 158 is inserted a further O-ring 160 which bears an the inside of the housing sleeve 138 and correspondingly separates the low-pressure space 106 sealingly from the surroundings. That end region of the housing sleeve 138 which is located on this side is bent inward (if appropriate, crimped) and bears on a frustaconial outer surface portion of the holding body 158. The magnet return plate 150, the magnet body 152 and the holding body 158 are thereby held firmly in the housing sleeve 138.

The holding body 158 projects in the axial direction with a stub 164 beyond the housing sleeve 138. The low-pressure connection piece 110 is screwed into the stub 164.

The armature 102 has an armature ring 168 which is welded to an armature shank 166 and which, as seen in the radial direction, is arranged within the magnet return plate 150 so as to form a narrow air gap. The armature shank 166 is guided in a stop sleeve 170 which, as seen in the axial direction, is supported on a supporting shoulder 172 on the magnet body 152. The stop sleeve 170 is welded or crimped to the magnet body 152 at 174, as shown. The stop sleeve 170 farms an axial stop for an annular shoulder 176 formed on the armature shank 166 and ensures that a gap remains between the armature ring 168 and the magnet body 152 when the armature 102 is attracted by the electromagnet 100. Contiguously to the radially inner end of the magnet return plate 150, the latter has, on the side facing the magnet body 152, a contiguous recess 178 which is always connected to the low-pressure space 106 through the magnet return plate 150 via connecting holes 180 running in the axial direction. This allows very rapid pressure equalization between the two sides of the armature ring 168 during the movement of the armature 102.

The armature 102 has a nose 182 which projects beyond the armature ring 168 in the axial direction toward the valve pin 98 and which is intended for cooperating with the valve pin 98. The nose 182 has a transverse bore 184 which issues into a blind-hole bore 186 in the armature shank 166. The armature shank 166, on the side facing away from the nose 182, projects with an end region beyond the stop sleeve 170 in the axial direction. Inserted there into the armature shank 166 is a plug 190, on which the armature spring 112 is supported on the other end. Further transverse bores 184' in the armature shank 166 connect its blind-hole bore 186, adjacently to the plug 190, to a space 192 which is arranged in the holding body 158 and is flow-connected to the low-pressure outlet connection piece 110 and in which is located the armature spring 112, the latter at the same time being supported on the holding body 158. The connecting duct 108 formed by the blind-hole bore 186, the transverse bores 184, 184' and the space 192 connects the low-pressure space 106 to the low-pressure connection piece 110.

In the situation shown in FIGS. 2 and 10, the electromagnet 100 is not excited, with the result that the valve pin 98 is held in bearing contact on the control body 72 by virtue of the force exerted by the armature spring 112. When the electromagnet 100 is excited, the armature ring 168, together with the armature shank 166, is attracted, with the gap between the armature ring 168 and the magnet body 152 at the same time being reduced, as a result of which the valve pin 98 can move away from the control body 72 in the axial direction, thus leading to an injection operation. During the de-excitation of the electromagnet, the armature 102 is moved in the opposite direction by the force of the armature spring 112, thus leading the valve pin 98 to close the throttle passage in the control body 72, with the result that the injection operation is terminated.

Since the armature springs 112 are subject to a production spread, it is necessary, in order to achieve highly accurate injection operations, for the electromagnet arrangement 16 to be calibrated. This is carried out by the choice of a suitable plug 190. For this purpose, plugs 190 are made available, which have a different axial distance between the surfaces with which the plugs come to bear, on the one hand, on the armature shank 166 and, on the other hand, on the armature spring 112. The bearing surface 142 serves as a base for the measuring means. In order to ensure the simple exchange of the plugs 190 during the calibrating operation, preferably both the largest outside diameter of the plug 190 and the outside diameter of the spring 112 are smaller than the guide diameter of the armature shank 166 in the stop sleeve 170.

The length of the valve pin 98 may also be selected as a function of the stroke which the armature 102 is to execute. The outer surface 144 serves as a base for measuring the distance between this surface and the control body 72.

The various embodiments of the fuel injection valve 10 according to the invention have a slender construction and afford a number of possibilities for adapting the properties to the desired profile of the injection operation.

The control devices 26 according to the invention may also be used in fuel injection valves which are otherwise differently constructed; thus, even in the case of fuel injection valves in which the fuel is supplied to the valve-seat element in the housing via a separate duct, and not coaxially to or along the axis 24 of the injector, but laterally in relation to this.

The electromagnet arrangement shown and described and its fastening to the housing of the fuel injection valve may be used in different fuel injection valves.

The tubular housing may also have, instead of a thread, differently designed generally known means for fastening an electromagnet arrangement.

A tubular housing with fastening possibilities far a valve-seat element, on the one hand, and, on the other hand, an electromagnet arrangement and a connecting collar with a high-pressure connection piece may also be used in differently designed fuel injection valves.

An injection-valve member, as described further above, in which the shank and the control piston are produced as individual parts, may be used in any desired fuel injection valves.

What is claimed is:

1. A fuel injection valve for intermittent fuel injection into the combustion space of an internal combustion engine, which comprises:

a housing having an injection valve-seat element, a double acting control piston, a slide-valve body, a control body, a pilot valve, a high-pressure inlet for a fuel, and an injection valve member for cooperating with said valve-seat element and being arranged for being longitudinally moveable in the housing and being spring-loaded in a direction toward said valve-seat element, said double-acting control piston being positioned on the injection-valve member and delimiting a high-pressure space flow-connected to the high-pressure inlet and delimiting a control space with said slide-valve body, said slide-valve body being guided in a sliding fit in said housing and which has a first end face likewise delimiting the control space, a second end face located opposite said first end face and a throttle passage extending between said first and second end faces, and said control body having a slide-valve seat cooperating with the second end face of the slide-valve body and which has a control passage formed therein which emanates from the slide valve seat, and which is flow-connected to the throttle passage and which is adapted to be communicated to a low-pressure space in said housing by said pilot valve, the throttle passage and the control passage being flow-connected to the high-pressure space via a throttle inlet and a gap which is formed when the slide-valve body lifts off said slide-valve seat for being flow-connected to the high-pressure space, wherein the slide-valve body has a second passage which issues into the control space and which is closed when the slide-valve body engages the control body and is connected to the high-pressure space when the slide-valve body is lifted off the control body.

2. The fuel injection valve as claimed in claim 1, wherein the second passage is closable by the control body when the slide-valve body engages the control body.

3. The fuel injection valve as claimed in claim 1, wherein the control passage and the passage are arranged so as to be offset relative to one another, and which form, when the slide-valve body engages the control body, a passageway delimited by the control body and the slide-valve body for connecting said control passage and said throttle passage to one another.

4. The fuel injection valve as claimed in claim 1, wherein a smallest cross sectional portion of the throttle inlet and of the throttle passage is smaller than a smallest cross sectional of the control passage.

5. The fuel injection valve as claimed in claim 1, which comprises a sleeve with which the control piston and slide-valve body are positioned wherein the control piston and the slide-valve body are arranged with a sliding fit in said sleeve for laterally delimiting the control space.

6. The fuel injection valve as claimed in claim 5, wherein the injection valve member has a stop member and the sleeve has a first counterstop cooperating with said stop member of the injection-valve member.

7. The fuel injection valve as claimed in claim 5, wherein the slide-valve body has a stop and the sleeve has a second counterstop for cooperating with said stop of the slide-valve body.

8. The fuel injection valve as claimed in claim 6, wherein a clearance formed between the counterstop and the stop of the injection-valve member, when the injection-valve member is in the closing position, is greater than a clearance formed between the second counterstop and the stop of the slide-valve body, measured when the slide-valve body engages the control body, and is smaller than a clearance formed between the slide-valve body and an end of the injection-valve member which faces the slide-valve body.

9. The fuel injection valve as claimed in claim 1, which comprises an electromagnetic device for controlling the pilot valve wherein the housing comprises a tubular body which circumferentially delimits the high-pressure space and which has a high-pressure inlet running in a radial direction thereof, said injection-valve member being arranged in the high-pressure space so as to form an annular space between a shank portion of the injection-valve member and the tubular body, the annular space extending as far as an end portion of the tubular body which faces the valve-seat element, and, at an end portion facing away from the valve-seat element, the tubular body comprises a fastening member for fastening said electromagnet device.

10. The fuel injection valve as claimed in claim 9, which comprises a valve pin and a union nut with an axial passage in a bottom part thereof and which is screwed onto the tubular body, wherein the axial passage has arranged therein said valve pin and wherein said valve pin is engagable with said control body for closing the control passage and for cooperating with an armature of the electromagnet device.

11. The fuel injection valve as claimed in claim 10, wherein the length of the valve pin is selectable as a function of a desired stoke of the armature and of the thickness of the bottom part.

12. The fuel injection valve as claimed in claim 1, wherein the injection-valve member has the control piston and a shank fastened to said control piston.

13. The fuel injection valve as claimed in claim 7, which comprises a closing spring, first and second rings, two supporting half flanges seated on said injection valve member and a one-piece supporting flange located in said housing and having a slot formed therein wherein said injection-valve member passes through said closing spring and said closing spring comprises a helical spring and which is supported on said first ring surrounding said two supporting half flanges and on said second ring, said second ring surrounding said one-piece supporting flange and being supported firmly in relation to the housing, said second ring having play in relation to the injection-valve member.

14. The fuel injection valve as claimed in claim 1, which comprises an electromagnet arrangement arranged in a housing sleeve for actuating said pilot valve, wherein the housing sleeve has a bearing surface which, in an assembled state, engages an outer surface of said bearing surface.

15. The fuel injection valve as claimed in claim 1 or 2, wherein the second passage comprises a throttle passage.

16. The fuel injection valve as claimed in claim 1 or 2, wherein the second passage comprises a further throttle passage.

17. The fuel injection valve as claimed in claim 1, wherein the throttle passage is arranged on the axis.

18. The fuel injection valve as claimed in claim 1 or 17, wherein the control piston comprises a projection and the throttle passage is closed by the projection toward the end of an opening stroke.

19. The fuel injection valve as claimed in any one of the claims 1, 2, 3, or 17, wherein the tubular housing comprises an upper end face, the control body is placed onto said upper end face, is held centrally and is sealingly pressed against the upper end face.

20. The fuel injection valve as claimed in any one of the claims 1, 2, or 3, wherein the throttle inlet is located in the slide-valve body.

21. The fuel injection valve as claimed in any one of the claims 1, 2, or 3, wherein the throttle inlet issues into the throttle passage on the side facing the control body with respect to the narrowest cross section.

22. The fuel injection valve as claimed in any one of the claims 1, 2, or 3 wherein the throttle inlet is located in the slide-valve body and issues into the throttle passage on the side facing the control body with respect to the narrowest cross section.

* * * * *